US005544790A

United States Patent [19]

Lu

[11] Patent Number: 5,544,790

[45] Date of Patent: Aug. 13, 1996

[54] PLASTIC SQUEEZE CONTAINER

[76] Inventor: Yen-Ho Lu, No. 12, Lane 25, Alley 301, Hsiao-Yang Road, Chang Hua, Taiwan

[21] Appl. No.: 547,359

[22] Filed: Oct. 24, 1995

[51] Int. Cl.[6] ..... B65D 37/00

[52] U.S. Cl. ..... 222/212; 222/185.1; 222/531; 222/534

[58] Field of Search ..... 222/184, 185.1, 222/212, 531, 532, 534

[56] References Cited

U.S. PATENT DOCUMENTS

| | | | |
|---|---|---|---|
| 2,800,259 | 7/1957 | Wilson et al. | 222/534 |
| 3,884,392 | 5/1975 | Hazard | 222/534 X |
| 4,645,097 | 2/1987 | Kaufman | 222/211 X |
| 4,776,501 | 10/1988 | Ostrowsky | 222/534 X |
| 4,819,832 | 4/1989 | Lawson | 222/531 X |
| 5,054,634 | 10/1991 | Margotteau | 222/531 X |

*Primary Examiner*—Gregory L. Huson
*Attorney, Agent, or Firm*—Bacon & Thomas

[57] ABSTRACT

A plastic squeeze container including a fluid container body having a neck and a side notch near the neck, a cap covered on the neck of the fluid container body and having side notch and a guide tube in the side notch, and a guide block fitted into the side notch of the container body and the side notch of the cap and turned about an axis on the cap between the close position in which the guide tube is closed to stop the fluid, and the open position in which the guide tube is opened to guide the fluid from the container body to the spout at one end of the guide block.

1 Claim, 5 Drawing Sheets

PLASTIC SQUEEZE CONTAINER

BACKGROUND OF THE INVENTION

The present invention relates to plastic squeeze containers, and relates more particularly to such a plastic squeeze container which can be opened and squeezed to force the fluid out of the spout by one hand by turning a guide block at one side of the container.

Plastic squeeze containers are commonly used for dispensing creams, hair conditioners, soybean sauce, and any of a variety of viscous fluids. FIG. 1 shows a plastic squeeze container for this purpose. This plastic squeeze container comprises a container body 4 having a threaded neck 41, a flat cover plate 5 fixedly covered on the threaded neck 41 and having a fluid outlet 51 at the center, and a screw cap 6 threaded onto the threaded neck 41 to close the fluid outlet 51. When in use, the screw cap 6 must be removed from the threaded neck 41 of the container body 4 so that the container body 4 can be squeezed to force the fluid out of the fluid outlet 51 of the flat cover plate 5. After each use, the screw cap 6 is threaded onto the threaded neck 41 to close the fluid outlet 51 again. Therefore, when to dispense the fluid, the user must use both hands to remove the screw cap 6 from the threaded neck 41 of the container body 4. Furthermore, because the fluid outlet 51 is at the top end of the thread neck 41 of the container body 4, the container body 4 must be turned upside-down and then squeezed to force the fluid out of the container body 4. If there is only a small amount of the fluid left in the container body 4, it takes much time to force the fluid away from the bottom end of the container body 4 to the fluid outlet 51 of the flat cover plate 5.

SUMMARY OF THE INVENTION

The present invention provides a plastic squeeze container which eliminates the aforesaid drawbacks. It is one object of the present invention to provide a plastic squeeze container which dispenses the fluid through a fluid passage at a bottom cap thereof. It is another object of the present invention to provide a plastic squeeze container which can be opened and squeezed to force the fluid out of the spout by one hand. It is still another object of the present invention to provide a plastic squeeze container which can be used with a regular plastic squeeze container by taking its cap away and then putting it on the inside of the container body of the present invention.

According to the preferred embodiment of the present invention, the plastic squeeze container comprises a fluid container body having a neck and a side notch near the neck, a cap covered on the neck of the fluid container body and having side notch and a guide tube in the side notch, and a guide block fitted into the side notch of the container body and the side notch of the cap and turned about an axis on the cap between the close position in which the guide tube is closed to stop the fluid, and the open position in which the guide tube is opened to guide the fluid from the container body to the spout at one end of the guide block.

DETAILED DESCRIPTION OF THE PREFERRED EMBODIMENT

Figure 1:
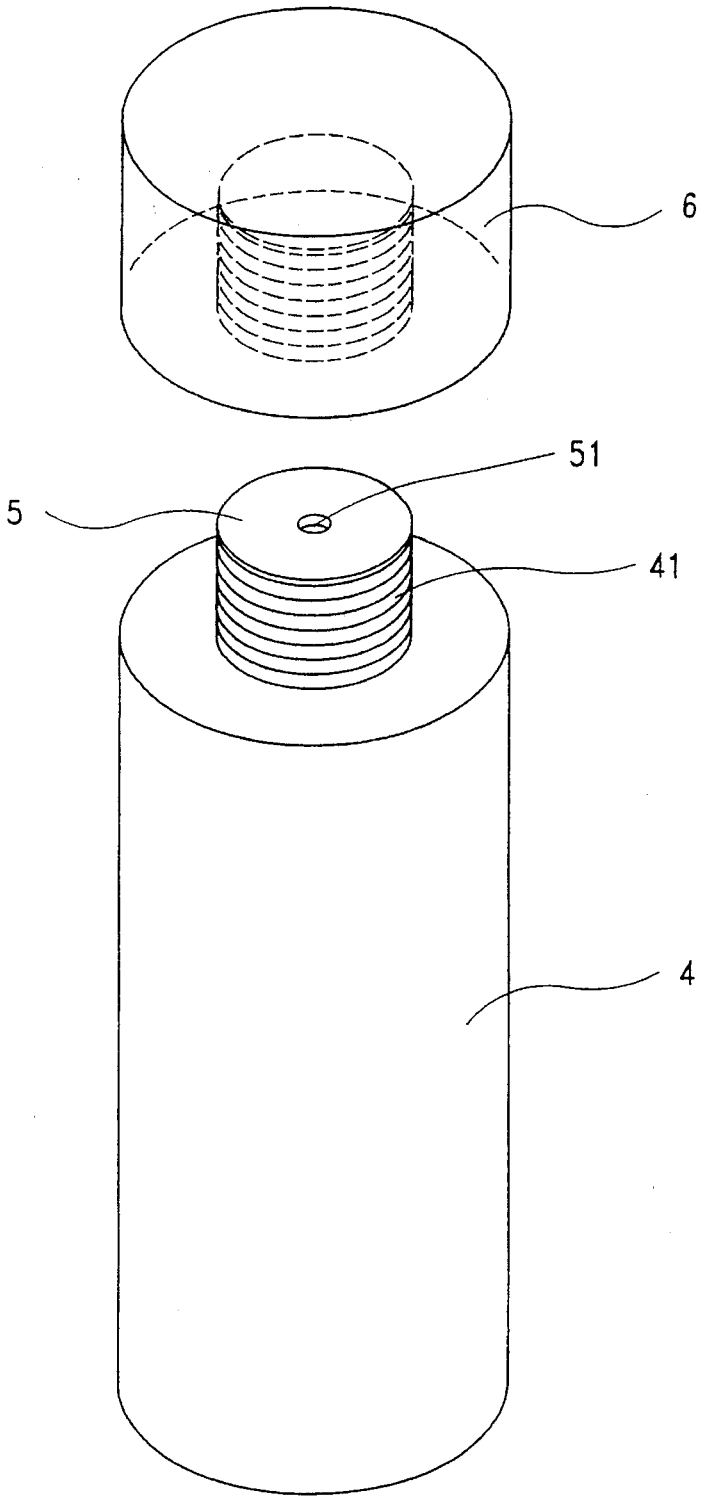
FIG. 1 (PRIOR ART)
FIG. 1 is an elevational view of a plastic squeeze container according to the prior art.
Figure 2:
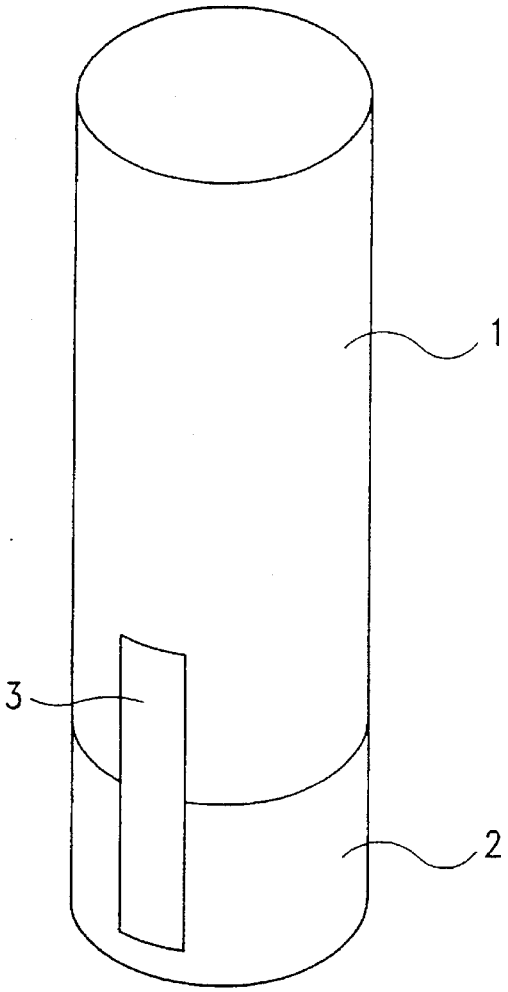
FIG. 2 is an elevational view of a plastic squeeze container according to the present invention.
Figure 3:
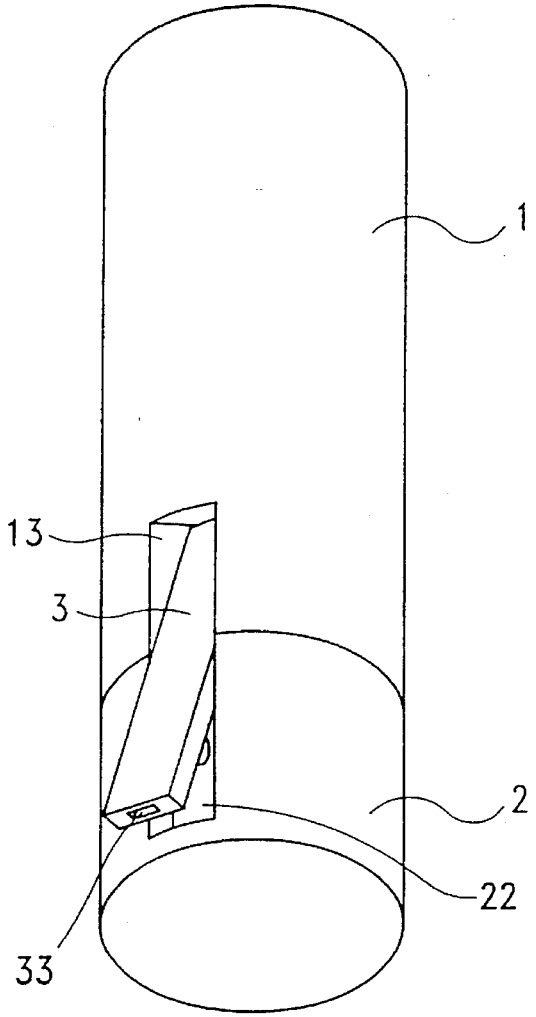
FIG. 3 is similar to FIG. 2 but showing the guide block turned to the open position.
Figure 4:
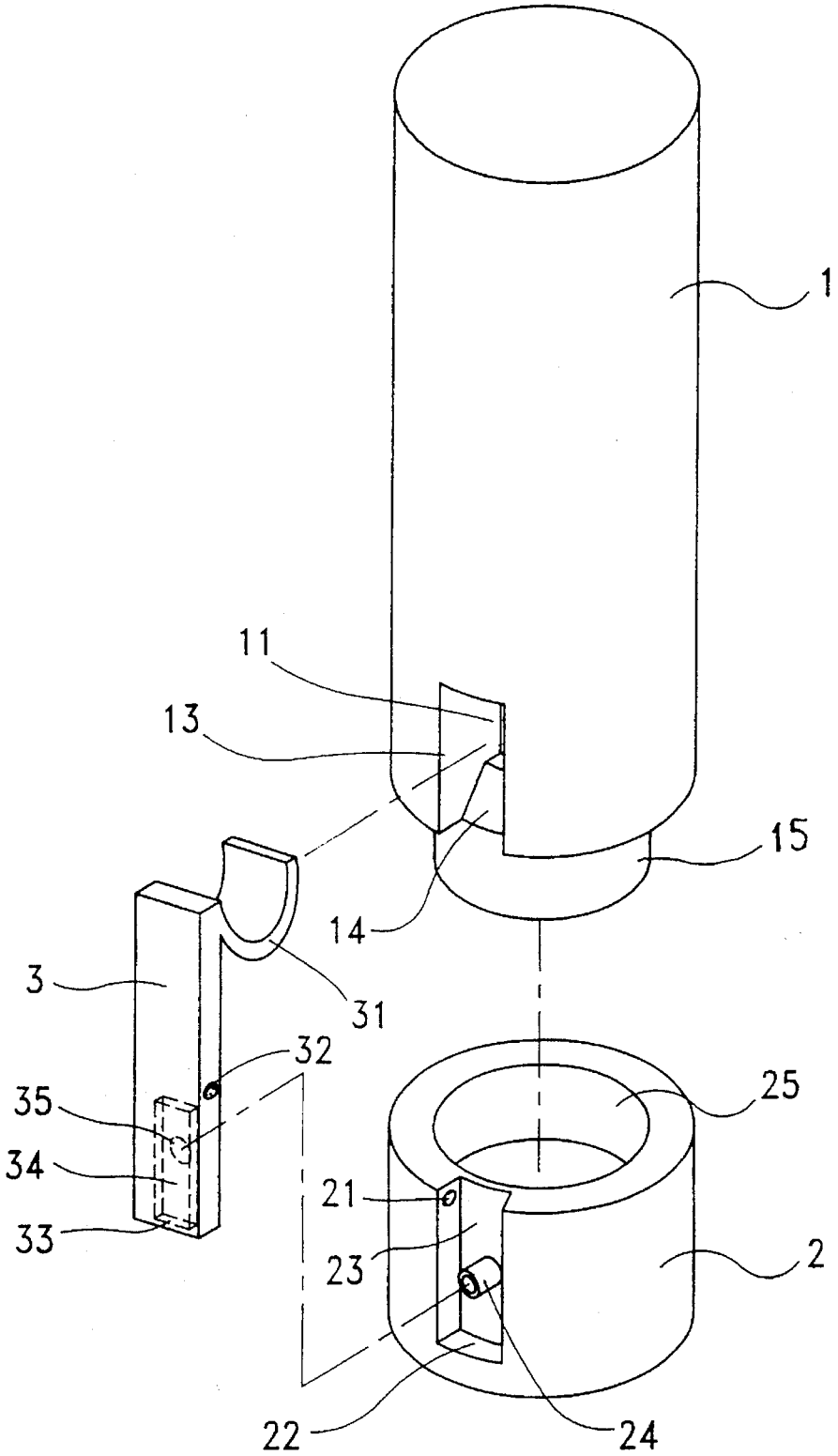
FIG. 4 is an exploded view of the plastic squeeze container shown in FIG. 2.
Figure 5A:
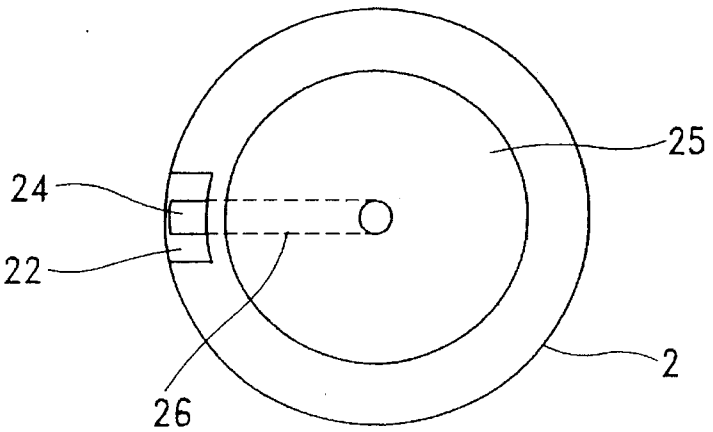
FIG. 5*a* is a top plain view of the cap shown in FIG. 5.
Figure 5B:
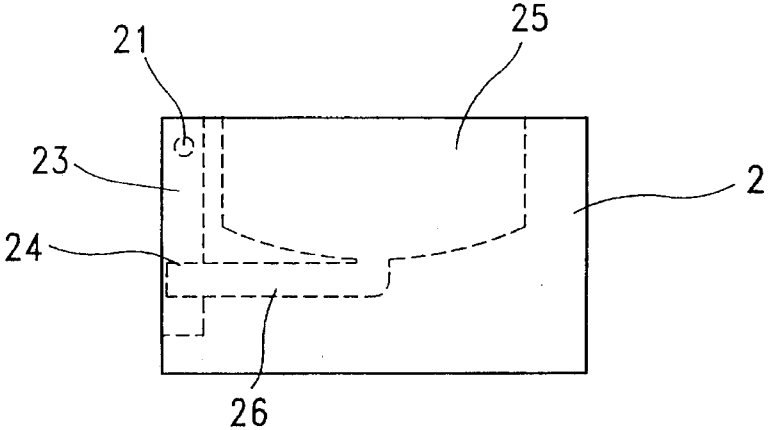
FIG. 5*b* is a side view in section of the cap shown in FIG. 5.
Figure 5:
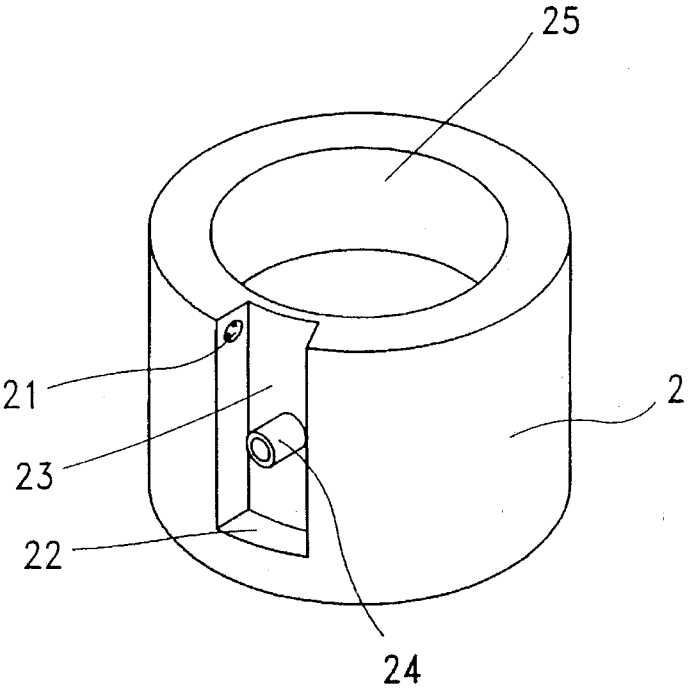
FIG. 5 is an elevational view of the cap for the plastic squeeze container shown in FIG. 4.

Referring to FIGS. 2, 3, 4, 5, 5*a*, and 5*b*, a plastic squeeze container in accordance with the present invention is generally comprised of a container body 1, a cap 2, and a guide block 3. The container body 1 comprises a neck 15 at one end, a first longitudinal side notch 13 adjacent to the neck 15, a recessed retaining hole 11 at one end of the first longitudinal side notch 13 remote from the neck 15, and a slope 14 longitudinally downwardly extended from the neck 15 to the recessed retaining hole 11. The cap 2 comprises a recessed hole 25 at one end, which receives the neck 15 of the container body 1, a second longitudinal side notch 22, which aligns with the first longitudinal side notch 13 of the container body 1 when the neck 15 is fitted into the recessed hole 25, a guide tube 24 perpendicularly extended from the bottom wall 23 of the second longitudinal side notch 22, two small recessed portions 21 respectively disposed at two opposite side walls of the second longitudinal side notch 22, and a fluid tube 26 in communication between the recessed hole 25 and a guide tube 24 (see FIGS. 5*a* and 5*b*).

Figure 6:
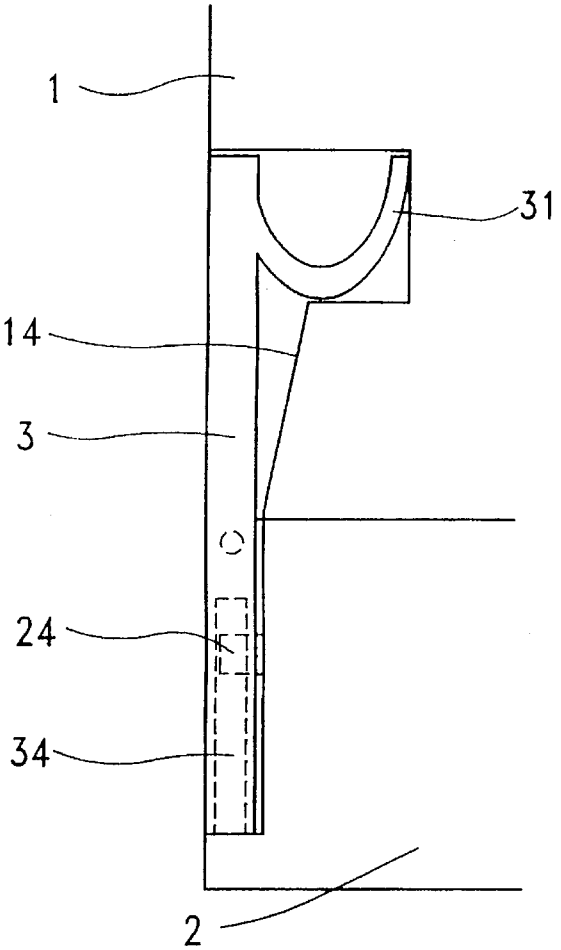
FIG. 6 is a sectional view in an enlarged scale of the lower part of FIG. 2, showing the guide tube stopped.

Referring to FIG. 6 and FIGS. 3 and 4 again, when the cap 2 is covered on the neck 15 of the container body 1, the longitudinal side notches 13 and 22 are aligned for mounting the guide block 3. The guide block 3 fits the combined side notches 13 and 22, having an arched, springy coupling portion 31 at one end fastened to the recessed retaining hole 11 of the container body 1, a spout 33 at an opposite end, a back hole 35, a fluid passage 34 in communication between the spout 33 and the back hole 35, and two small raised portions 32 at two opposite lateral sides corresponding to the small recessed portions 21 of the cap 2. When the coupling portion 31 is fastened to the recessed retaining hole 11 of the container body 1, the guide block 3 is fitted into the longitudinal side notches 13 and 22, permitting the raised portions 32 and the back hole 35 to be respectively engaged with the recessed portions 21 and the guide tube 24. When assembled, the guide block 3 can be turned about the axis which passes through the small recessed portions 21 between the close position (see FIG. 6) and the open position (see FIG. 7).

Referring to FIGS. 2 and 6 again, when the guide block 3 is turned to the close position, it is disposed in flush with the container body 1 and the cap 2, and the guide tube 24 is stopped against the peripheral wall of the fluid passage 34 of the guide block 3, therefore the guide tube 24 is stopped, and fluid is prohibited from passing to the spout 33.

Figure 7:
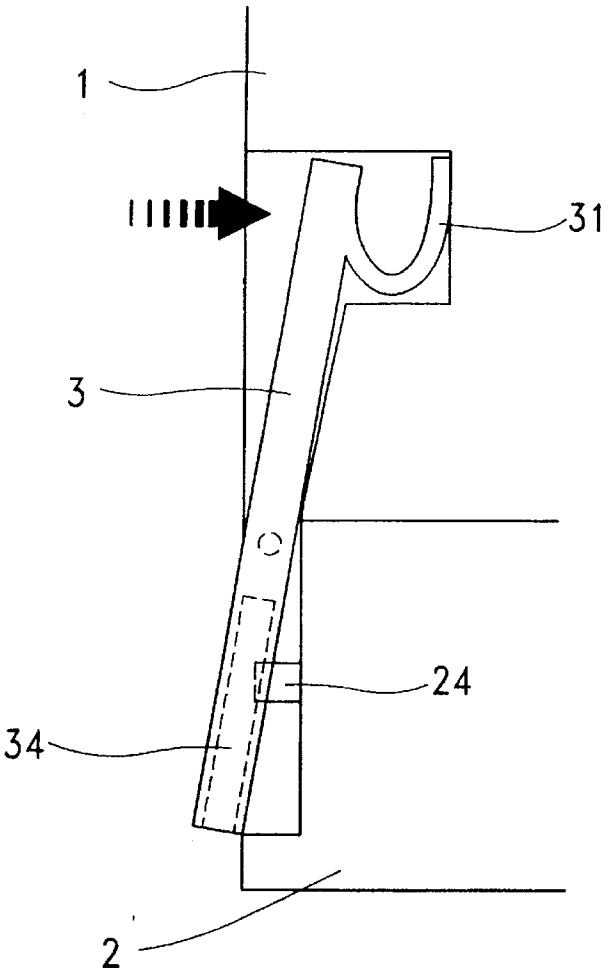
FIG. 7 is a sectional view in an enlarged scale of the lower part of FIG. 3, showing the guide tube opened.

Referring to FIG. 7 and FIG. 3 again, when the guide block 3 is turned to compress the springy coupling portion 31 and to move the spout 33 out of the second longitudinal side notch 22 of the cap 2, the peripheral wall of the fluid passage 34 of the guide block 3 is disconnected from the guide tube 24, therefore the guide tube 24 is opened for letting the fluid flow from the container body 1 through the recessed hole 25 and fluid tube 26 of the cap 2 to the spout 33 via the fluid passage 34 of the guide block 3. When the guide block 3 is released from the hand, the springy coupling portion 31 of the guide block 3 immediately returns to its former shape, causing the guide block 3 turned to its former position to close the guide block 24 again.

Furthermore, by detaching the cap 2 from the neck 15 of the container body 1, a regular plastic squeeze container whose cap is removed can be put in the container body 1, and then covered by the cap 2 for easy dispensing.

It is to be understood that the drawings are designed for purposes of illustration only, and are not intended as a definition of the limits and scope of the invention disclosed.

I claim:

1. A plastic squeeze container comprising:

a container body to hold a fluid, said container body comprising a neck at a bottom end thereof, a first longitudinal side notch adjacent to said neck, a recessed retaining hole at one end of said first longitudinal side notch of said container body remote from said neck, and a slope longitudinally downwardly extended from said neck to said recessed retaining hole;

a cap covered on said neck of said container body, said cap comprising a recessed bottom hole, which receives said neck of said container body, a second longitudinal side notch, which aligns with the first longitudinal side notch of said container body when said neck of said container body is fitted into said recessed bottom hole of said cap, a guide tube in said second longitudinal side notch of said cap, two small recessed portions at two opposite side walls of 20 said second longitudinal side notch of said cap, and a fluid tube in communication between said guide tube and said recessed bottom hole; and a guide block fitted into said first longitudinal side notch of said container body and said second longitudinal side notch of said cap, said guide block comprising a springy coupling portion at one end fastened to said recessed retaining hole of said container body, a spout at an opposite end, a back hole coupled to said guide tube of said cap, a fluid passage in communication between said spout and said back hole, and two small raised portions at two opposite lateral sides respectively turned in the small recessed portions of said cap, said guide block turned on said two small raised portion of said guide block between first position in which said guide tube is closed and a second position in which said guide tube is opened.

* * * * *